US006312300B1

(12) United States Patent
Asai

(10) Patent No.: US 6,312,300 B1
(45) Date of Patent: Nov. 6, 2001

(54) 2-CYCLE ENGINE AND A WATERCRAFT HAVING THE 2-CYCLE ENGINE INSTALLED THEREIN

(75) Inventor: Masahiro Asai, Saitama (JP)

(73) Assignee: Honda Giken Kogyo Kabushiki Kaisha

( * ) Notice: Subject to any disclaimer, the term of this patent is extended or adjusted under 35 U.S.C. 154(b) by 0 days.

(21) Appl. No.: 09/537,765

(22) Filed: Mar. 30, 2000

(30) Foreign Application Priority Data

Mar. 30, 2000 (JP) ..... 11-089835

(51) Int. Cl.[7] ..... B63H 11/00
(52) U.S. Cl. ..... 440/88
(58) Field of Search ..... 440/38, 88, 89; 123/41.31, 41.08

(56) References Cited

U.S. PATENT DOCUMENTS 5,109,809 * 5/1992 Fujimoto ..... 123/41.31
5,261,356 * 11/1993 Takahashi et al. ..... 123/41.31
5,752,863 * 5/1998 Baker et al. ..... 440/38
5,788,547 * 8/1998 Ozawa et al. ..... 440/89

* cited by examiner

*Primary Examiner*—Ed Swinehart
(74) *Attorney, Agent, or Firm*—Birch, Stewart, Kolasch & Birch, LLP

(57) ABSTRACT

A high output 2-cycle engine and a watercraft powered by the 2-cycle engine. The 2-cycle engine includes a crank case having a water jacket, and a cylinder block with a water jacket for cooling the cylinder block. Cooling water is supplied separately to the crank case water jacket and the cylinder block water jacket to increase cooling of the crank case and the cylinder block. The 2-cycle engine may be an air scavenging engine in which fresh air is supplied to the engine through the crank case, and fuel is injected into a combustion chamber by a fuel injection device. The cylinder head and the exhaust manifold of the engine may also include water jackets.

16 Claims, 4 Drawing Sheets

(a)

(b)

2-CYCLE ENGINE AND A WATERCRAFT HAVING THE 2-CYCLE ENGINE INSTALLED THEREIN

BACKGROUND OF THE INVENTION

1. Field of the Invention

This invention relates to a 2-cycle engine and a watercraft having the engine installed therein.

2. Related Art

A conventional 2-cycle engine is operated such that fresh air is sucked into the crank chamber formed by the crank case, and the fresh air is fed into the combustion chamber formed between the cylinder head and the piston through a scavenging passage.

A conventional air-fuel mixture scavenging type sucks only fresh air into the crank chamber. In the air scavenging type, fuel is supplied to the combustion chamber in addition to the fresh air.

Conventional watercraft utilize a jet pump propulsion means driven by a 2-cycle engine as described above. Since a small 2-cycle engine delivers a high output, the engine is particularly useful in a small-sized watercraft.

In the case of the 2-cycle engine, since the fresh air sucked into the crank chamber is fed into the combustion chamber, an increased temperature in the crank chamber (i.e. the crank case) causes the temperature of the fresh air to increase. As the temperature of the fresh air increases, the amount of oxygen per unit volume of the engine is reduced, resulting in reduced combustion efficiency. This reduces the engine output.

Accordingly, a watercraft utilizing a conventional 2-cycle engine does not realize the expected high output from the 2-cycle engine.

It is an object of the present invention to provide a 2-cycle engine and a watercraft having the 2-cycle engine realizing a high engine output.

SUMMARY OF THE INVENTION

In order to attain the above object and other objects not attained by the conventional art, a 2-cycle engine includes a crank case provided with a water jacket for cooling the crank case. The cylinder block is also provided with a water jacket, and the cooling water is supplied to the water jacket of the crank case through a supplying passage separate from another cooling water supplying passage for the water jacket of the cylinder block.

The 2-cycle engine may be an air scavenging type.

The watercraft includes a jet pump propulsion means driven by the engine. Cooling water is supplied from the jet pump to the water jacket.

Since the crank case is provided with the water jacket to cool the crank case, an increase in temperature of the crank case (i.e. the crank chamber) is reduced, which reduces the increase in temperature of the fresh air sucked into the crank chamber.

Since an amount of oxygen of fresh air per unit volume is increased, its combustion efficiency is improved and a high engine output can be attained.

In addition, since the cylinder block is also provided with a water jacket, an increase in temperature of the cylinder block is decreased which further increases engine output.

If the supplying passage for supplying cooling water to the water jacket of the crank case and the supplying passage for supplying cooling water to the water jacket of the cylinder block are formed by a common passage, the water that once cooled the crank case may be supplied to the water jacket of the cylinder block, or, the water that once cooled the cylinder block may be supplied to the water jacket of the crank case, resulting in reduced cooling of the cylinder block and the crank case.

According to the present invention, cooling water may be supplied to the water jacket of the crank case through the supplying passage separate from the cooling water supplying passage for the water jacket of the cylinder block, avoiding the above disadvantage. It thus becomes possible to attain a higher engine output.

Since the 2-cycle engine is an air scavenging type, the fresh air sucked into the crank chamber includes only air, and fuel in addition to the fresh air (air) from the scavenging passage is supplied to the combustion chamber. Accordingly, as compared with that of the air-fuel mixture scavenging type, fuel consumption is reduced.

If the 2-cycle engine of air scavenging type is not cooled, a temperature of the crank chamber is easily increased, decreasing engine output. If both the crank case and the cylinder block are provided with water jackets, fuel consumption is reduced, combustion efficiency is improved, and a high engine output can be attained.

The watercraft according to the present invention can include a jet pump acting as a propulsion means driven by an engine. The 2-cycle engine described can deliver a high output to the jet pump.

In addition, since the cooling water from the jet pump is supplied to the water jacket of the engine, both the crank case and the cylinder block are efficiently cooled.

The jet pump is driven by the engine, so that as the number of rotations of the engine is increased (as the temperature of the engine is increased), a larger amount of cooling water is supplied from the jet pump to each of the water jackets in each of the crank case and the cylinder block through a respective supplying passage (individually). Accordingly, the crank case and the cylinder block are proportionately cooled in response to the rotation of the engine. In addition, it is not necessary to provide a water pump for supplying cooling water to the water jackets.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are limitative of the present invention, and wherein:

FIG. 4(*b*) is a schematic view of the operation of an embodiment of the present invention.

DETAILED DESCRIPTION OF THE PREFERRED EMBODIMENTS

Figure 1:
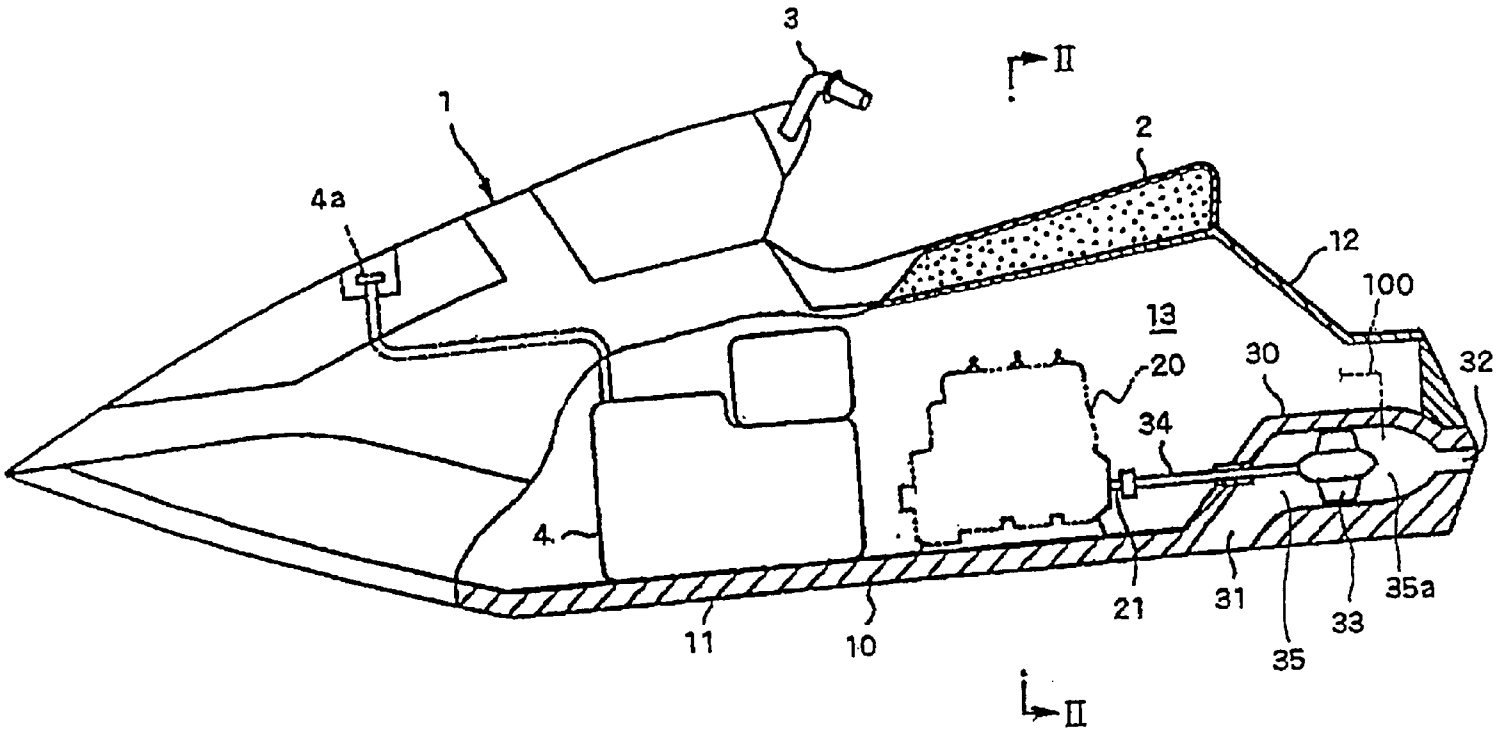
FIG. 1 is a side elevational view of a 2-cycle engine according to the present invention and an embodiment of a watercraft on which the engine is installed.
Figure 2:
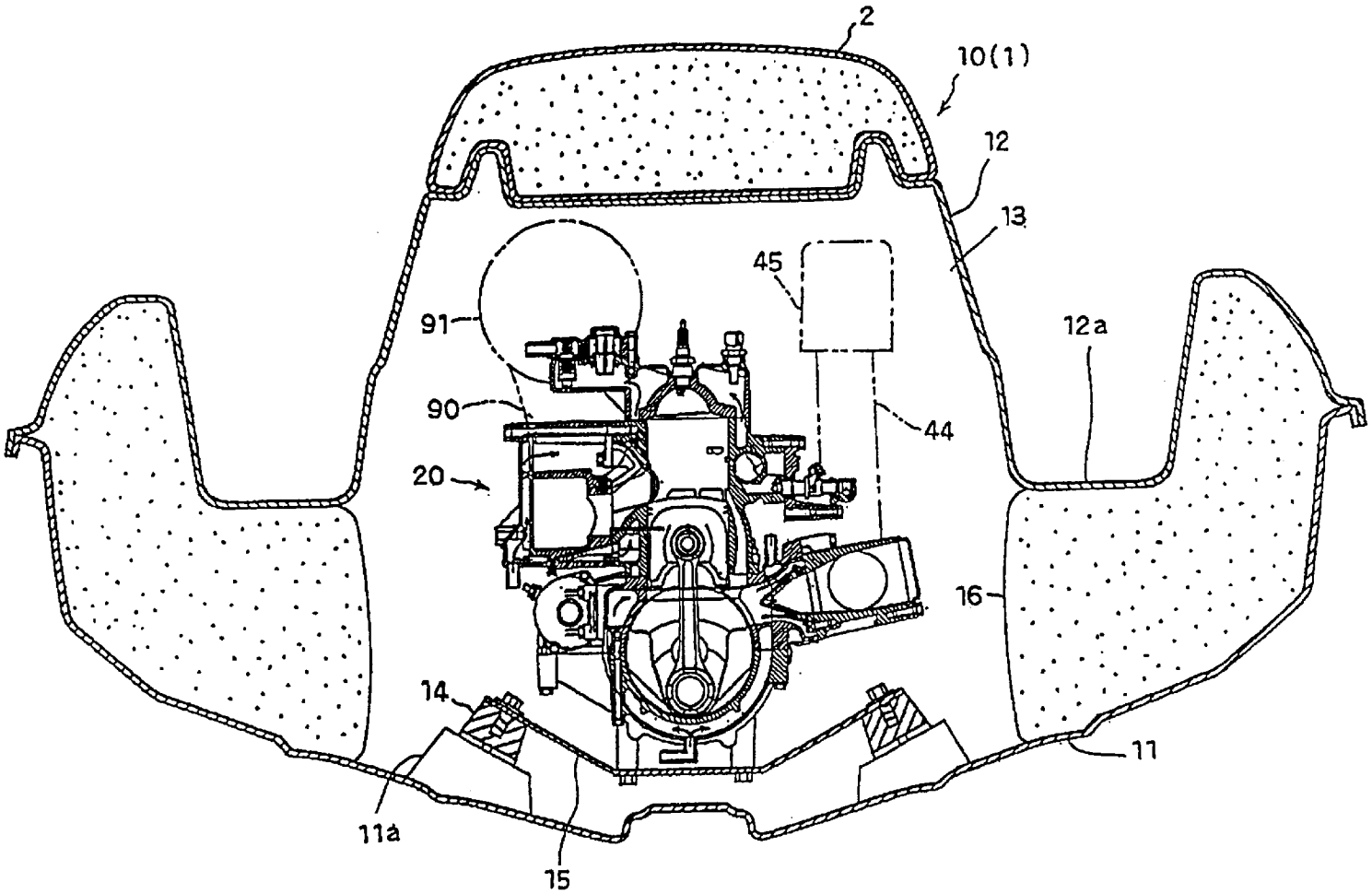
FIG. 2 is a sectional view taken along line II—II of FIG. 1.

As shown in FIGS. 1 and 2, a watercraft 1 is a saddle-type vehicle in which a driver sits on a seat 2 on a hull 10. The driver steers the watercraft 1 by a steering handle 3 having a throttle grip.

The hull 10 is a buoyant structure in which a lower hull panel 11 and an upper hull panel 12 are connected to each other to form a space 13 therein. An engine 20 is mounted on the lower hull panel 11 in the space 13 through its hubs 11*a*, mounting blocks 14, and an engine hanger 15. A jet pump 30 driven by the engine 20 is arranged at the rear part of the lower hull panel 11.

The jet pump 30 has a flow passage 35 extending from a water inlet 31 in the hull 10 to a jet nozzle 32 opened at the rear of the hull 10. The jet pump 30 includes an impeller 33 disposed in the flow passage 35. A shaft 34 of the impeller 33 is connected to an output shaft 21 of the engine 20. Accordingly, when the impeller 33 is rotationally driven by the engine 20, water fed through the water inlet 31 is injected out of the jet nozzle 32, thereby propelling the hull 10.

Reference numeral 4 denotes a fuel tank and reference numeral 4a denotes a fuel supplying port. In FIG. 2, reference numeral 12*a* denotes a foot rest and reference numeral 16 denotes a buoyancy member composed of foamed material and the like.

Figure 3:
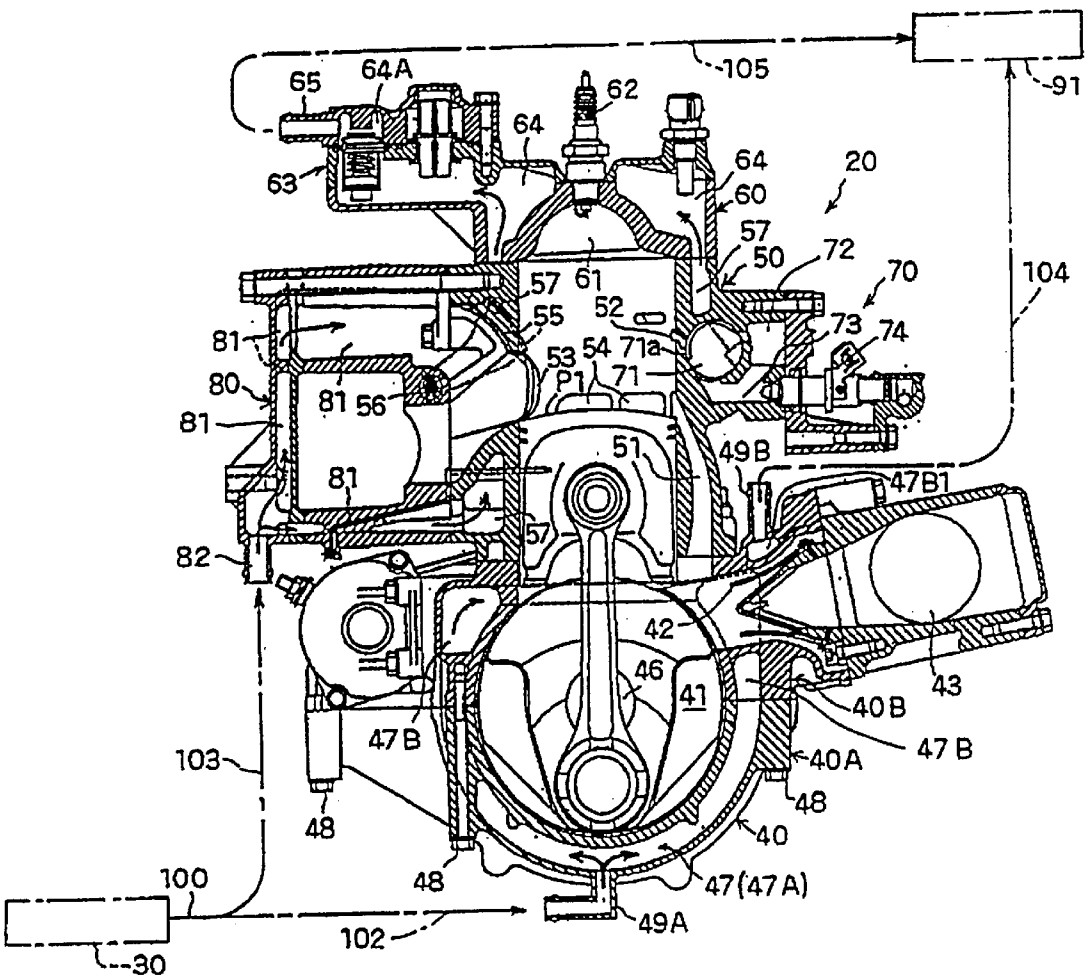
FIG. 3 is a sectional view of an embodiment of a 2-cycle engine according to the present invention.

As shown in FIG. 3, the engine 20 is a parallel multi-cylinder type 2-cycle engine having a crank case 40, a cylinder block 50, and a cylinder head 60. Fresh air is sucked into a crank chamber 41 formed by the crank case 40 through a reed valve 42. The fresh air is fed into a combustion chamber 61 formed between the cylinder head 60 and a piston P through a scavenging passage 51 and burned.

An air cleaner 45 is arranged upstream of the air intake passage 43 provided with the reed valve 42 through an air intake pipe 44 (see FIG. 2). This 2-cycle engine 20 is an air scavenging type in which fresh air sucked into the crank chamber 41 only includes air. Fuel is supplied to the air in the combustion chamber 61.

Reference numeral 70 denotes a fuel injection device. The fuel injection device 70 includes a rotary valve 71 for opening or closing a fuel injection port 52 formed at an inner surface of the cylinder block 50, an accumulator 72 which can be communicated with the fuel injection port 52 through the rotary valve 71, a reserve well passage 73 communicated with the accumulator 72 that can be communicated with the fuel injection port 52 through the rotary valve 71, and a fuel injector 74 for metering a proper amount of fuel and feeding it into the reserve well passage 73.

The rotary valve 71 has a shallow concave groove-like communicating passage 71*a* extending partially (approximately over 180°) about its circumference. The rotary valve is rotated synchronously with the crank shaft 46 in an opposite direction (a counter-clockwise direction as viewed in the FIG. 3) to that of a crank shaft 46.

An operation of the engine 20 will be described below.

FIG. 3 shows a state at the time of completion of the scavenging stroke. As the piston P enters from this state into an air intake stroke where the piston P is moved upwardly, the reed valve 42 is opened and fresh air is fed into the crank chamber 41 through the air cleaner 45 and the intake pipe 44. When the piston P is moved upwardly to enter into a compression stroke and an exhaust port 53 is closed by the piston P (or a state where it is approximately closed), the communicating passage 71*a* of the rotary valve 71 causes the reserve well passage 73 to be communicated with the fuel injection port 52. The fuel fed into the reserve well passage 73 (described later) is then injected into the cylinder through the fuel injection port 52 with high pressure gas filled in the accumulator 72.

After the above operation, when the piston P is moved upwardly to cause an ignition plug 62 at the cylinder head 60 to be ignited, the piston P enters an explosion and expansion stroke and the piston P is moved downwardly, a piston head P1 passes over the part of the fuel injection port 52, and the fuel injection port 52 is opened. Thereafter the communicating passage 71*a* of the rotary valve 71 causes the fuel injection port 52 to be communicated with the accumulator 72 and high pressure fills the accumulator 72.

Feeding of a proper amount of fuel into the reserve well passage 73 through the fuel injector 74 is carried out before the fuel injection is performed again after the fuel injection. After this operation, when the exhaust port 53 is opened upon a further downward motion of the piston P, the exhausting operation is carried out, the exhaust port 54 is opened upon a further downward motion of the piston P, resulting in that scavenging is performed. The piston P returns back to the state shown in FIG. 3 and then the operation is repeated.

The exhaust port 53 is provided with an exhaust manifold 80 communicated with the exhaust port 53, and further downstream, an exhaust chamber 91 through an exhaust pipe 90 (refer to FIG. 2) is provided. In addition, the exhaust port 53 is provided with an exhaust control valve 55 of which an opening degree can be adjusted between 0 and 100%. A shaft 56 serves as a pivot of rotation of the exhaust control valve 55, and is disposed within the exhaust manifold 80.

The cylinder head 60 is provided with a thermostat 63 operated in response to a water temperature in a water jacket 64.

In the case of the 2-cycle engine described above, for example, since the fresh air sucked into the crank chamber 41 is fed to the combustion chamber 61, if no cooling measures are taken, the temperature in the crank chamber 41 (i.e. the crank case 40) is increased. This reduces the output of the engine.

In particular, in the case of an air scavenging type engine, only air is sucked into the crank chamber 41, and cooling action caused by fuel added to the air is not attained. The temperature within the crank chamber 41 is therefore easily increased, and engine output may decrease.

In view of the foregoing, a preferred embodiment of the present invention includes a crank case 40 with a water jacket 47 for cooling the crank case 40, as shown in FIG. 3.

The crank case 40 in this embodiment is constituted such that a lower case 40A and an upper case 40B are connected by bolts 48, and the water jacket 47 is arranged over both cases. Water jacket 47 includes a water jacket 47A in the lower case 40A and a water jacket 47B in the upper case 40B that communicate with each other. The bottom part of the lower case 40A is provided with a feeding pipe 49A for feeding cooling water (either sea water or river water) fed from the jet pump 30, and an uppermost part 47B1 of the water jacket 47B at the upper case 40B is provided with a drain pipe 49B for discharging the cooling water flowed from the water jacket 47B toward the exhaust chamber 91.

In addition, the cylinder block 50 may also be provided with a water jacket 57, and each of the exhaust manifold 80 and the cylinder head 60 may be provided with water jackets 81 and 64, respectively.

An outside part of the exhaust manifold 80 is provided with another feeding pipe 82 separate from the feeding pipe 49A of the crank case 40 for feeding cooling water flowed from the jet pump 30 into the water jacket 81, in which the cooling water fed from the feeding pipe 82 is supplied to the water jacket 57 of the cylinder block 50 through the water jacket 81 of the exhaust manifold 80, and further supplied to the water jacket 64 of the cylinder head 60 through the water jacket 57.

An uppermost part 64A of the water jacket 64 in the cylinder head 60 positioned at the thermostat 63 is provided with a drain pipe 65 for discharging the cooling water flowed from the water jacket 64 toward the exhaust chamber 91.

Figure 4A:
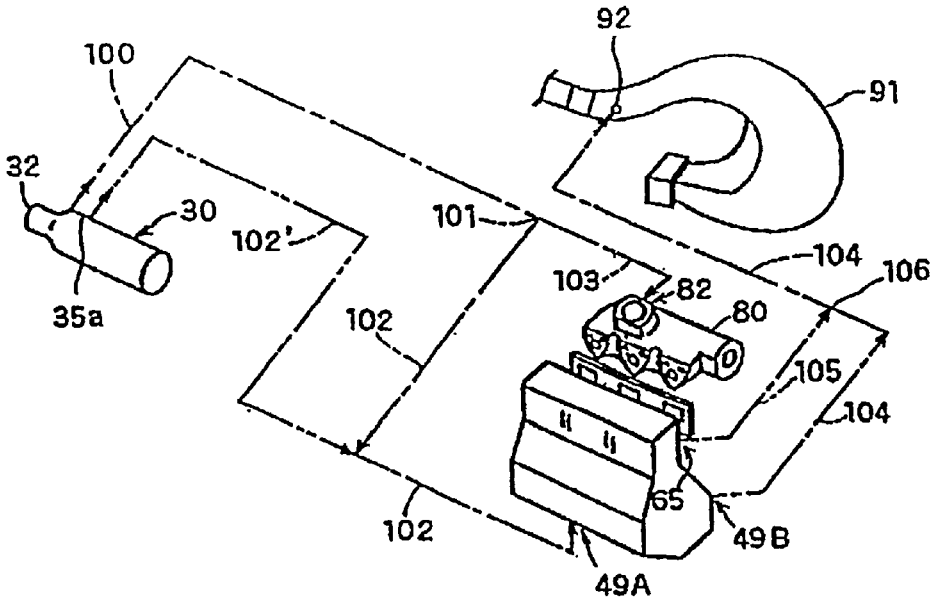
FIG. 4(*a*) is a schematic view of cooling passages according to the present invention.
Figure 4B:
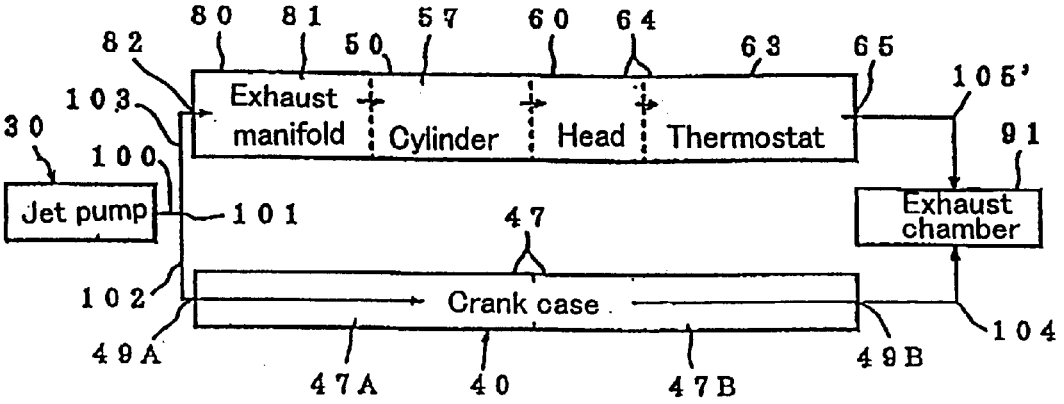

FIGS. 4(*a*) and (*b*), show schematically the passages for the cooling water described above. A cooling water feeding pipe 100 is connected to a location 35*a* between the impeller 33 in the flow passage 35 of the jet pump 30 and the jet nozzle 32 (see FIG. 1), and the feeding pipe 100 is branched at a branch part 101 into two pipes 102, 103. One pipe 102 is connected to the feeding pipe 49A of the crank case 40, and the other pipe 103 is connected to the feeding pipe 82 of the exhaust manifold 80.

As shown by a dotted line 102' in FIG. 4(*a*), it is also applicable that the pipe 102 connected to the feeding pipe 49A of the crank case 40 does not branch from the feeding pipe 100, but is instead directly connected to the jet pump 30. In any case, the cooling water is supplied to the water jacket 47 of the crank case 40 through the supplying passage 102 separate from the cooling water supplying passage 103 for the water jacket 57 of the cylinder block 50.

As shown in FIG. 4(*a*), the drain pipe 49B of the crank case 40 is connected to a cooling water feeding pipe 92 communicated with a water jacket (not shown) in the exhaust chamber 91 through the pipe 104. In addition, a pipe 105 is connected to a drain pipe 65 of the cylinder head 60, this pipe 105 merges into the pipe 104 at a flow merging part 106 with the pipe 104, and this pipe 105 is connected to the feeding pipe 92 of the exhaust chamber 91. In addition, as indicated by a reference numeral 105' in FIGS. 3 and 4(*b*), it is also applicable that the drain pipe 65 of the cylinder head 60 and the feeding pipe 92 of the exhaust chamber 91 may not be merged at the pipe 104, but instead directly connected by the pipe 105'.

As described above, the cooling water passage is divided into two passages:

One of the passages is a passage ranging from the jet pump 30→the feeding pipe 100 (or a pipe 102')→the pipe 102→the feeding pipe 49A→the water jacket 47 (47A, 47B) of the crank case 40→the drain pipe 49B→the pipe 104→the water jacket of the exhaust chamber 91.

The other passage is a passage ranging from the jet pump 30→the feeding pipe 100→the pipe 103→the feeding pipe 82→the water jacket 81 of the exhaust manifold 80→the water jacket 57 of the cylinder block 50→the water jacket 64 of the cylinder head 60→the water jacket 64A around the thermostat 63→the drain pipe 65→the pipe 105→the pipe 104 (or the pipe 105')→the water jacket of the exhaust chamber 91.

In accordance with the 2-cycle engine 20 described above, following advantages can be attained:

Since the crank case 40 is provided with the water jacket 47 for cooling the crank case, an increase in temperature of the crank case 40 (i.e. the crank chamber 41) is reduced and an increase in temperature of fresh air sucked into the crank chamber 41 is accordingly reduced. Because the amount of oxygen per unit volume of fresh air is increased, combustion efficiency is improved and a high engine output can be attained.

In addition, since the cylinder block 50 is also provided with the water jacket 57, an increase of temperature in the cylinder block 50 is also reduced, further increasing engine output. In a preferred embodiment, cooling water is supplied to the water jacket 47 of the crank case 40 through the supplying passage 102 (the feeding pipe 49A) separate from the cooling water supplying passage 103 (the feeding pipe 82) for the water jacket 57 of the cylinder block 50, so that the crankcase 40 and the cylinder block 50 are additionally cooled.

Since the 2-cycle engine 20 is an air scavenging type, fresh air sucked into the crank chamber 41 includes only air, and fuel separate from the fresh air (air) flowed from the scavenging passage 51 is supplied to the combustion chamber 61. Accordingly, its fuel consumption is reduced as compared with that of air-fuel mixture scavenging type engines.

The watercraft 1 utilizes a jet pump 30 as a propulsion means driven by the engine, so that the watercraft 1 is moved forward by the jet pump 30. This machine is small in size and yields a high engine output. Further, since cooling water is supplied from the jet pump 30 to the water jackets 47, 57 of the engine 20, the crank case 40 and the cylinder block 50 or the like are efficiently cooled. The jet pump 30 is driven by the engine 20, and cooling water is therefore supplied from the jet pump 30 to the water jackets 47, 57 in proportion to the speed of the engine 20. An added advantage is that it is not necessary to include a water pump to supply cooling water to the water jacket.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A 2-cycle engine comprising:

a cylinder block including a cylinder block water jacket, the cylinder block water jacket being capable of conveying cooling water to cool the cylinder block; and a crank case including a crank case water jacket, the crank case water jacket being capable of conveying cooling water to cool the crank case, wherein the cooling water supplied to the crank case water jacket is separate from the cooling water supplied to the cylinder block water jacket.

2. The 2-cycle engine of claim 1, wherein a first cooling water supplying passage is operatively connected to the crank case water jacket to supply cooling water to the crank case water jacket, and a second cooling water supplying passage is operatively connected to the cylinder block water jacket to supply cooling water to the cylinder block water jacket, the first and second cooling water passages supplying separate flows of cooling water to the crank case water jacket and the cylinder block water jacket.

3. The 2-cycle engine of claim 1, wherein the 2-cycle engine is an air-scavenging engine.

4. The 2-cycle engine of claim 3, wherein the crank case includes an air intake passage opening into an interior of the crank case.

5. The 2-cycle engine of claim 1, further comprising a fuel supply device mounted on the cylinder block, the cylinder block including a fuel supply port through which the fuel supply device can supply fuel to a combustion chamber of the engine.

6. The 2-cycle engine of claim 5, further comprising an exhaust manifold in fluid communication with the combustion chamber, the exhaust manifold including an exhaust manifold water jacket capable of conveying cooling water to cool the exhaust manifold.

7. The 2-cycle engine of claim 6, further comprising a cylinder head mounted on the cylinder block, the cylinder head including a cylinder head water jacket capable of conveying cooling water to cool the cylinder head.

8. The 2-cycle engine of claim 6, wherein the exhaust manifold water jacket, the cylinder block water jacket, and the cylinder head water jacket are in fluid communication so that cooling water flows from the exhaust manifold water jacket to the cylinder block water jacket, and then to the cylinder head water jacket.

9. The 2-cycle engine of claim 7, further comprising a thermostat mounted on the cylinder head to detect a temperature of the cylinder head water jacket, the thermostat including a thermostat water jacket, wherein cooling water flows from the cylinder head water jacket to the thermostat water jacket.

10. A watercraft comprising:

a hull;

a propulsion device; and an engine, the engine comprising, a cylinder block including a cylinder block water jacket, the cylinder block water jacket being capable of conveying cooling water to cool the cylinder block, and a crank case including a crank case water jacket, the crank case water jacket being capable of conveying cooling water to cool the crank case, wherein the cooling water supplied to the crank case water jacket is separate from the cooling water supplied to the cylinder block water jacket.

11. The watercraft of claim 10, wherein a first cooling water supplying passage is operatively connected to the crank case water jacket to supply cooling water to the crank case water jacket, and a second cooling water supplying passage is operatively connected to the cylinder block water jacket to supply cooling water to the cylinder block water jacket, the first and second cooling water passages supplying separate flows of cooling water to the crank case water jacket and the cylinder block water jacket.

12. The watercraft of claim 10, wherein the engine is an air-scavenging engine, the crank case including an air intake passage opening into an interior of the crank case.

13. The watercraft of claim 10, wherein the engine further includes a fuel supply device mounted on the cylinder block, the cylinder block including a fuel supply port through which the fuel supply device can supply fuel to a combustion chamber of the engine.

14. The watercraft of claim 13, wherein the engine further includes an exhaust manifold in fluid communication with the combustion chamber, the exhaust manifold including an exhaust manifold water jacket capable of conveying cooling water to cool the exhaust manifold.

15. The watercraft of claim 14, wherein the engine further includes a cylinder head mounted on the cylinder block, the cylinder head including a cylinder head water jacket capable of conveying cooling water to cool the cylinder head, wherein the exhaust manifold water jacket, the cylinder block water jacket, and the cylinder head water jacket are in fluid communication so that cooling water flows from the exhaust manifold water jacket to the cylinder block water jacket, and then to the cylinder head water jacket.

16. The watercraft of claim 10 wherein:

the propulsion device includes a jet pump operatively connected to the engine to receive a driving force from the engine; and cooling water is supplied to the crank case water jacket by the jet pump.

* * * * *